US008789776B2

(12) United States Patent
Lee

(10) Patent No.: US 8,789,776 B2
(45) Date of Patent: Jul. 29, 2014

(54) APPARATUS PREVENTING FERROUS OBJECTS FROM ENTERING A GARBAGE DISPOSAL

(76) Inventor: Ronald K. Lee, Haiku, HI (US)

( * ) Notice: Subject to any disclaimer, the term of this patent is extended or adjusted under 35 U.S.C. 154(b) by 366 days.

(21) Appl. No.: 13/280,923

(22) Filed: Oct. 25, 2011

(65) Prior Publication Data

US 2013/0032648 A1 Feb. 7, 2013

Related U.S. Application Data

(60) Provisional application No. 61/514,224, filed on Aug. 2, 2011.

(51) Int. Cl.
*B02C 25/00* (2006.01)
*B02C 23/36* (2006.01)

(52) U.S. Cl.
USPC ..... 241/30; 241/46.013; 241/46.016

(58) Field of Classification Search
USPC ..... 241/46.013–46.016, 30
See application file for complete search history.

(56) References Cited

U.S. PATENT DOCUMENTS 2,597,601 A * 5/1952 Sherman ..... 43/57.1
4,089,474 A * 5/1978 Timmer ..... 241/46.016
4,253,616 A * 3/1981 Timmer ..... 241/46.016
6,636,135 B1 * 10/2003 Vetter ..... 335/205
7,066,415 B2 * 6/2006 Strutz ..... 241/36
7,533,835 B2 * 5/2009 Hanson ..... 241/33
7,817,002 B2 * 10/2010 Fullerton et al. ..... 335/306
8,453,356 B2 * 6/2013 Mian ..... 36/136
8,584,976 B1 * 11/2013 Melin et al. ..... 241/36
2007/0181718 A1 * 8/2007 Hanson ..... 241/36
2011/0296578 A1 * 12/2011 Lee ..... 2/48
2012/0180197 A1 * 7/2012 Cosky ..... 2/338
2013/0205476 A1 * 8/2013 Gentile et al. ..... 2/311

* cited by examiner

*Primary Examiner* — Faye Francis

(74) *Attorney, Agent, or Firm* — Welsh Flaxman & Gitler LLC

(57) ABSTRACT

A magnetic strap for preventing the undesired passage of articles through a sink drain hole and into a garbage disposal includes a strap member having a first end and a second end, with mating fastening members provided at the first end and the second end for selectively securing the first end to the second end so as to form a loop. A plurality of magnets are secured to the strap member, the magnets exhibiting sufficient strength to attract and trap ferrous objects by drawing the ferrous objects toward a sink flange where the ferrous objects are frictionally held to thereby prevent the ferrous objects from inadvertently slipping through the sink drain hole and into the garbage disposal.

12 Claims, 4 Drawing Sheets

APPARATUS PREVENTING FERROUS OBJECTS FROM ENTERING A GARBAGE DISPOSAL

CROSS REFERENCE TO RELATED APPLICATION

This application claims the benefit of U.S. Provisional Patent Application Ser. No. 61/514,224, entitled "MAGNETIC STRAP FOR GARBAGE DISPOSER", filed Aug. 2, 2011.

BACKGROUND OF THE INVENTION

1. Field of the Invention

The present invention is in the technical field of household and commercial garbage disposals, more particularly, an apparatus that prevents ferrous objects from entering the garbage disposal.

2. Description of the Related Art

Various devices are known for garbage disposal magnetic inhibitors or flatware retrievers. For example, U.S. Pat. No. 4,706,818 to Zutell, Nov. 17, 1987; U.S. Pat. No. 6,000,643 to Gelder, Dec. 14, 1999; U.S. Pat. No. 6,347,759 to Sedlak, Feb. 19, 2002; and U.S. Pat. No. 6,626,297 to Dailey, Sep. 30, 2003 disclose various garbage disposal magnetic inhibitors or flatware retrievers. The prior devices are designed to fit over the sink drain hole or inside the entrance to the garbage disposal. The prior devices not only impede the flow of water and food waste by decreasing the diameter of the drain hole, they also come in direct and constant contact with food waste and water, which when collected over time can diminish their effectiveness, as well as cause bacteria and odors to form.

Another problem with some of the prior devices is the risk that the magnetic components themselves may become dislodged and fall into the garbage disposal, in effect causing the problem they are meant to prevent.

The present invention overcomes the shortcomings of these prior devices by providing a garbage disposal magnetic inhibitor or flatware retriever that is mounted outside the garbage disposal, under the sink.

SUMMARY OF THE INVENTION

It is, therefore, an object of the present invention to provide a magnetic strap for preventing the undesired passage of articles through a sink drain hole and into a garbage disposal. The magnetic strap includes a strap member having a first end and a second end, with mating fastening members provided at the first end and the second end for selectively securing the first end to the second end so as to form a loop. A plurality of magnets is secured to the strap member, the magnets exhibiting sufficient strength to attract and trap ferrous objects by drawing the ferrous objects toward a sink flange where the ferrous objects are frictionally held to thereby prevent the ferrous objects from inadvertently slipping through the sink drain hole and into the garbage disposal.

It is also an object of the present invention to provide a magnetic strap wherein the mating fastening members are hook-and-loop type fastening material.

It is another object of the present invention to provide a magnetic strap wherein hook material is formed on a first side of the strap member and loop material is formed on an opposite second side of the strap member.

It is a further object of the present invention to provide a magnetic strap wherein each of the plurality of magnets is coupled to the first side of the strap member.

It is also an object of the present invention to provide a magnetic strap wherein each of the plurality of magnets is made of a ferromagnetic material, such as Neodymium Iron Boron (NIB), Samarium Cobalt (SmCo), or Alnico.

It is another object of the present invention to provide a magnetic strap wherein each of the plurality of magnets has a strength of at least 2,000 Gauss.

It is a further object of the present invention to provide a magnetic strap in combination with a garbage disposal secured to a sink for preventing the undesired passage of articles through a sink drain hole and into the garbage disposal. The garbage disposal includes a sink flange coupling the garbage disposal with the sink drain hole of the sink. The combination comprises a garbage disposal secured to a sink flange extending from the sink and a magnetic strap secured about the sink flange. The magnetic strap includes a strap member having a first end and a second end, with mating fastening members provided at the first end and the second end for selectively securing the first end to the second end so as to form a loop. The magnetic strap includes a plurality of magnets secured to the strap member, the magnets exhibiting sufficient strength to attract and trap ferrous objects by drawing the ferrous objects toward a sink flange where the ferrous objects are frictionally held to thereby prevent the ferrous objects from inadvertently slipping through the sink drain hole and into the garbage disposal.

It also an object of the present invention to provide a method for preventing the undesired passage of articles through a sink drain hole and into a garbage disposal by applying a plurality of magnets about a sink flange connecting a sink to a garbage disposal such that a magnetic field of the plurality of magnets transfers through the sink flange and onto the sink drain hole attracting and trapping any ferrous object located in the sink by drawing the ferrous object toward a sink flange where the ferrous object is frictionally held.

Other objects and advantages of the present invention will become apparent from the following detailed description when viewed in conjunction with the accompanying drawings, which set forth certain embodiments of the invention.

DESCRIPTION OF THE PREFERRED EMBODIMENT

Figure 1:
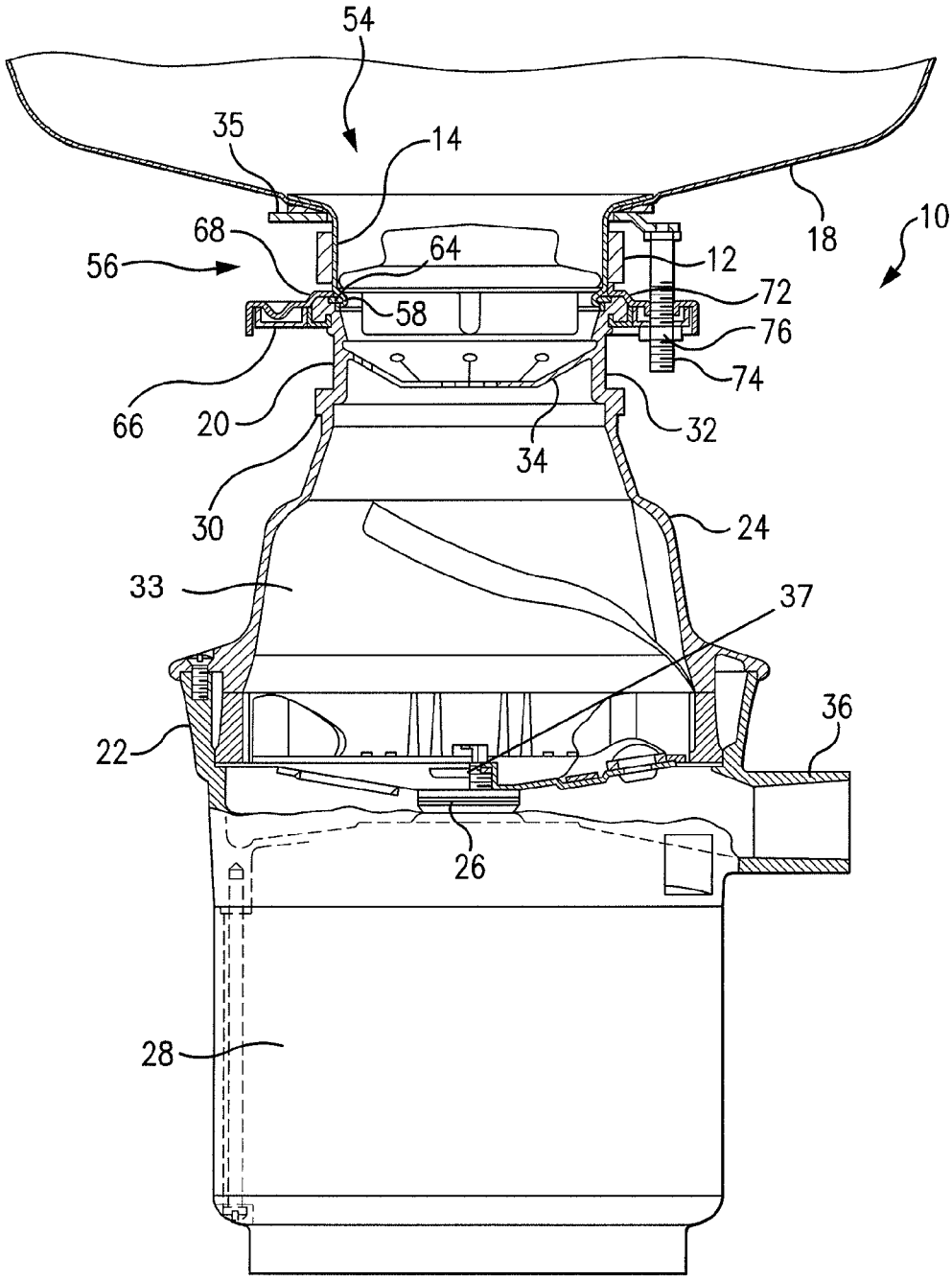
FIG. 1 is a partial cross-sectional view of a garbage disposal with the present magnetic strap secured thereto.

The detailed embodiment of the present invention is disclosed herein. It should be understood, however, that the disclosed embodiment is merely exemplary of the invention, which may be embodied in various forms. Therefore, the details disclosed herein are not to be interpreted as limiting, but merely as a basis for teaching one skilled in the art how to make and/or use the invention.

In accordance with the present invention, and with reference to the various figures, a garbage disposal 10 and associated apparatus 12 for preventing the undesired passage of articles through a drain hole 54 of a sink 18 and into the garbage disposal 10, in particular, a garbage disposal magnetic inhibitor or flatware retriever, is disclosed. The present invention prevents ferrous objects, such as utensils or flatware, from slipping into a garbage disposal, therefore avoiding possible damage to the object itself and/or the disposal, as well as possible injury. The apparatus is a magnetic strap 12 shaped and dimensioned for positioning about the outside of a sink flange, or drainage sleeve, 14 of the garbage disposal 10 with the magnets 16 facing inwards toward the sink flange 14. It is appreciated the present invention may be employed in conjunction with a variety of garbage disposals. For the purposes of the present description, the garbage disposal is constructed and secured to the sink in the following manner.

Figure 2:
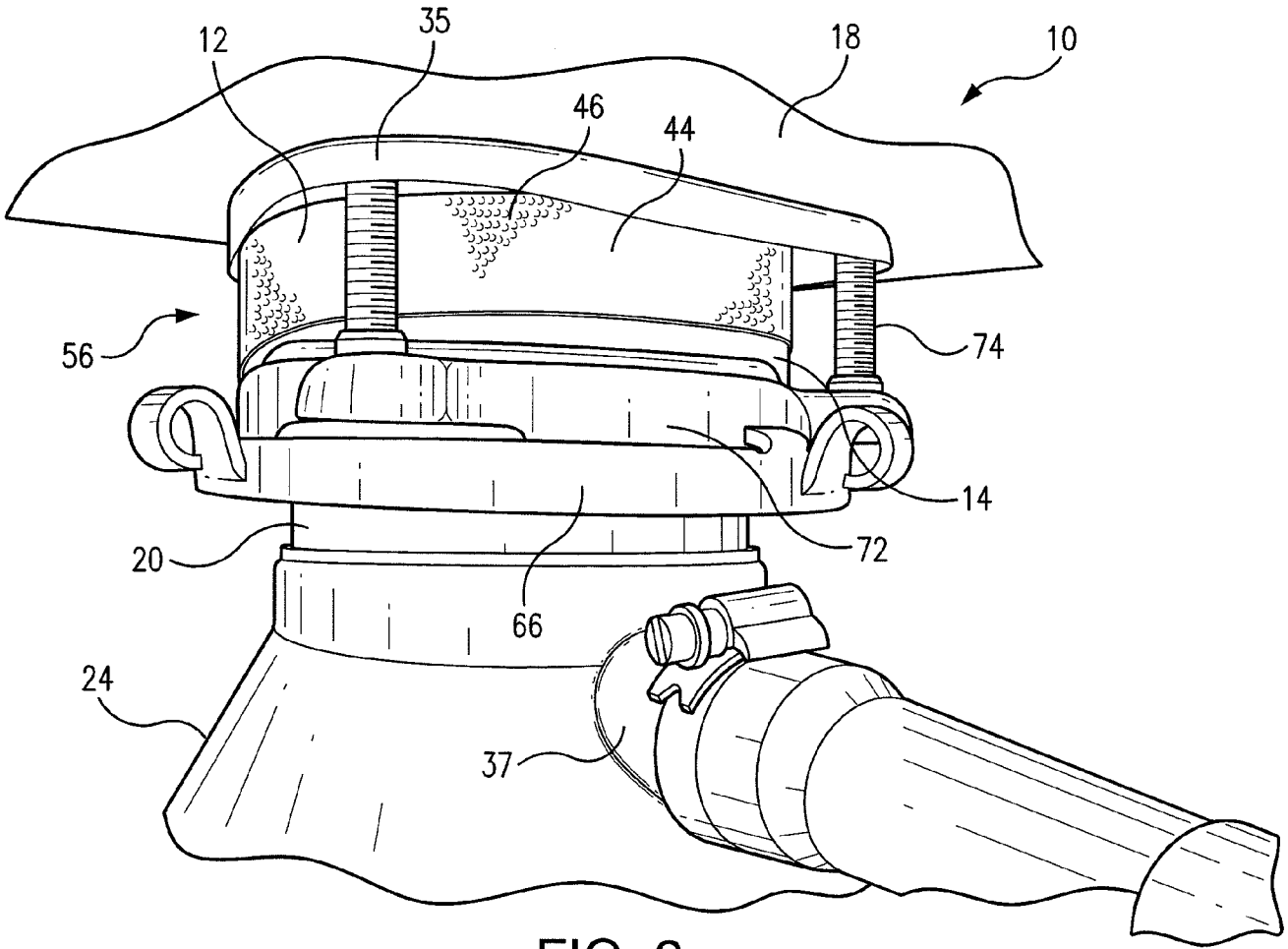
FIG. 2 is a view of the magnetic strap installed on a standard garbage disposal.
Figure 3:
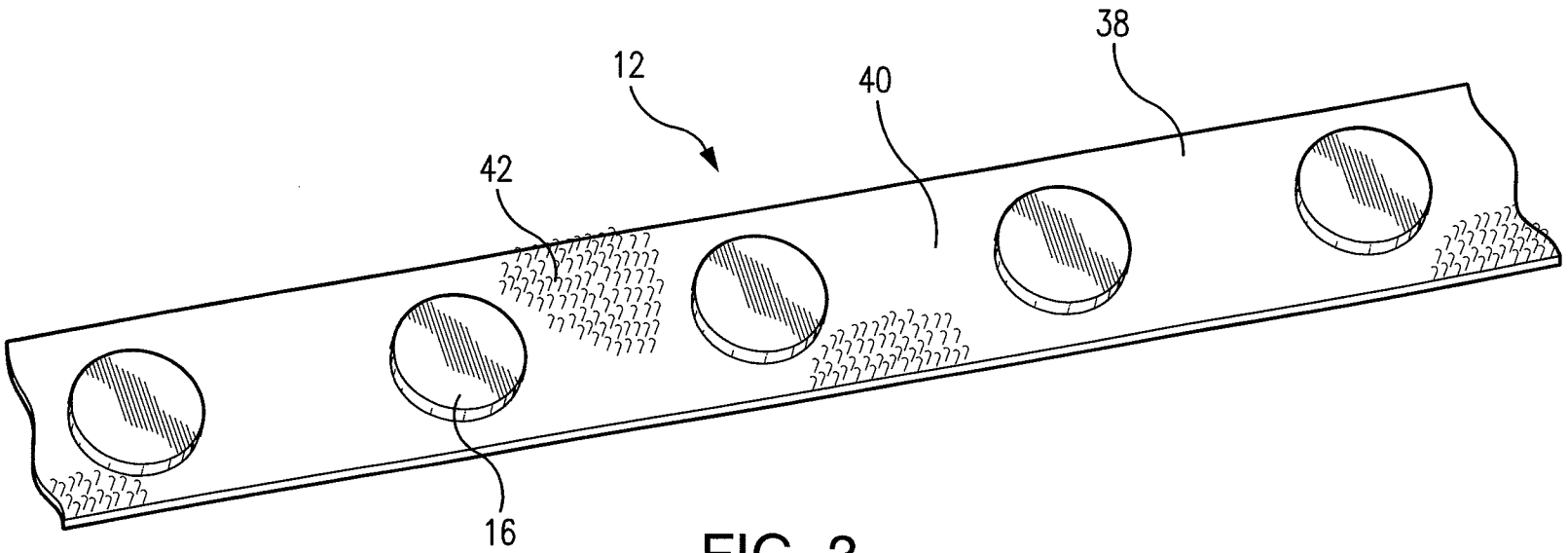
FIG. 3 is a detailed frontal view of the magnetic strap in an open configuration.
Figure 4:
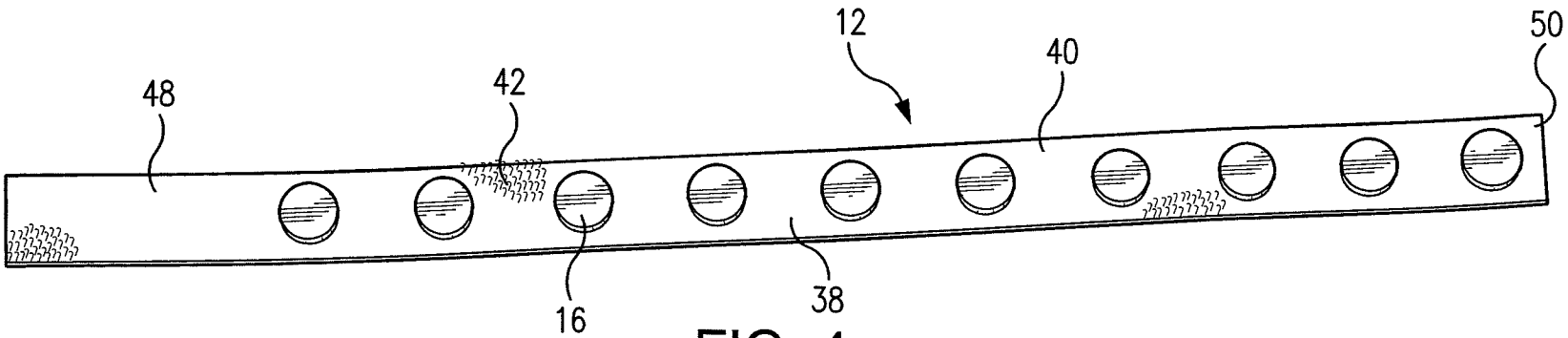
FIG. 4 is a frontal view of the magnetic strap in an open configuration.

With reference to FIGS. 1 and 2, a garbage disposal 10 secured beneath a sink 18 is disclosed. The garbage disposal 10 includes a sink flange 14 which allows for the assembly and installation of the garbage disposal in a suspended position from a kitchen sink bottom; that is, the garbage disposal 10 includes a sink flange 14 coupling the garbage disposal 10 with the sink drain hole 54 of the sink 18. The sink flange 14 is preferably metallic and is flanged at its upper end to be carried by the sink 18. The sink flange 14 in turn supports a suspending neck 20 through the medium of an appropriate positioning and suspension mechanism.

Generally, and as will be appreciated by those skilled in the art, the garbage disposal 10 is composed of a lower housing 22 and an upper housing 24, with an annular grind ring 26 clamped therebetween. The motor, not illustrated, is housed in a motor housing 28 secured to the bottom of the lower housing 22.

The upper end 30 of the upper housing 24 of the garbage disposal 10 is joined (or integrally formed with) to the lower end 32 of the suspending neck 20. The lower housing 22 is provided with any appropriate outlet connection 36 for attachment to a waste gathering system, not illustrated. The upper housing 24 may also be provided with an inlet 37 for connection with a dishwasher, for example.

A suspension mechanism 56 is employed for attaching the suspending neck 20 to the sink flange 14. Such suspension mechanisms are well known as disclosed in U.S. Pat. No. 3,076,611, which is incorporated herein by reference, and summarized below. When the annular seat 58 is formed in the lower end portion of the sink flange 14, there results an outwardly facing annular groove into which groove is snapped a split ring 64. The peripheral portion of the split ring 64 provides an upwardly facing annular seat upon which rests an inner annular portion of a mounting ring 70. The inner edge of the mounting ring 70 provides leading portions whose inner edges are flush with the outer main wall of the sink flange 14, such seating portions 68 overhanging the mentioned upwardly facing annular seat of the split ring 64. However, portions of the mounting ring 70 intermediate the seating portions 68 are struck up to form upstanding lugs 72 which at their upper end provide inner faces which bear against the outer wall of the sink flange 14 to prevent edges of the seating portions 68 from slipping into the annular groove above the mounting ring 70, and thus causing partial disengagement of the seating portions 68 from the split ring 64. The lower portions of the lugs 72 bear upon the corresponding edge portions of the spit ring 64 as seen at the right of FIG. 1. Opposite each lug 72 there is provided a bolt hole to receive a threaded portion of a bolt 74. The clamping ring 66 which underlies the mounting ring 70 is retained in the illustrated clamping position by nuts 76 threaded on to the lower ends of the bolts 74. Thus, when the bolts 74 are positioned in the bind ring 35 and the clamp ring 66 is drawn up by the nuts 76, the parts are retained in a clamping position.

Household waste is introduced to the garbage disposal 10 through the sink flange 14 from the sink 18 into a grinding chamber 33 formed by the upper housing 24 by way of a throat defined by the resilient suspending neck 20. A stopper 34 is conveniently employed to close the passage through the suspending sleeve 20, as required.

The grinding mechanism employed by garbage disposals is well known to those skilled in the art as disclosed in U.S. Pat. No. 3,076,611, which is incorporated herein by reference. It is appreciated a wide variety of garbage disposals are known and installed in homes and the present invention is considered applicable to those garbage disposals permitting use of the present inventive concept.

Referring now to the magnetic strap 12 of the present invention, the magnetic strap 12 is generally composed of a strap member 38 to which a plurality of individual magnets 16 is secured. In accordance with a preferred embodiment of the present invention, each individual magnet 16 is rectangular in shape, measuring 0.375 inches by 0.500 inches, or circular (as shown in the drawings), and has a thickness of 0.0125 inches. The magnets 16 are made of a ferromagnetic material, such as Neodymium Iron Boron (NIB), Samarium Cobalt (SmCo), or Alnico. Ceramic magnets are not recommended due to their brittle nature. The strength of each magnet 16 should be at least 2,000 Gauss, or N35 for NIB magnets. It has been found that magnets with strengths of 2,000 Gauss are sufficient to function in accordance with the intended purpose of the invention.

The individual magnets 16 are secured to the strap member 38. As will be discussed below, and in accordance with a preferred embodiment of the present invention, the strap member 38 is composed of hook-and-loop type fastening material, wherein a first side 40 of the strap member 38 is composed of the hook material 42 and the opposite second side 44 of the strap member 38 is composed of the loop material 46. In accordance with a preferred embodiment, the strap member 38 measures 0.750 inches wide by 14 inches long, with a thickness of 0.080 inches. However, it is appreciated the strap member may be of various lengths so long as it is long enough to wrap completely around the sink flange.

The individual magnets 16 are equally spaced along the length of the strap member 38. In accordance with a preferred embodiment, ten individual magnets 16 are employed and the magnets 16 are rectangular in shape. The ten magnets 16 are arranged about 1" apart, and affixed to the "hook" side, that is, the first side 40, of the strap member 38 via a heavy-duty or industrial strength bonding agent. It is appreciated the magnets 16 should be spaced so as not to create large spaces therebetween that increase the chance for a utensil to slip through the drain by creating gaps in the generated magnetic field. In addition, fewer but bigger magnets are not desired as with larger flat magnets part of the surface area will not touch the sink flange (because they cannot flex to curvature) and thereby provide less magnetic pull.

The strap member 38 includes a first end 48 and a second end 50, the first and second ends 48, 50 of the strap member 38 being provided with mating fastening members, that is, the hook-and-loop type fastening material 42, 46 discussed above, allowing for selective attachment of the first and second ends 48, 50 of the strap member 38 in a manner defining a closed loop. In accordance with a preferred embodiment, and as briefly discussed above, the fastening members are hook-and-loop type fastening members 42, 46 secured, or formed, at the respective first and second ends 48, 50 of the strap member 38 such that one end of the strap member 38 is provided with the hook material 42 needed for fastening and the other end is provided with the loop material 46 needed for fastening so that the first and second ends 48, 50 of the strap member 38 may be selectively fastened by overlapping the two ends 48, 50. It is appreciated that other fastening materials may be employed. It is also appreciated the fastening structure may only be located at the ends of the strap member.

The magnetic strap 12 is easily secured to a garbage disposal 10 by an average person, without any tools, on most existing garbage disposal 10. The installation is completed in the following manner. One end, for the purposes of explanation, we will say the first end 48, of the strap member 38 is slipped between one of the garbage disposal's mounting ring screws or bolts 74 and the sink flange 14. The magnetic strap 12 is then wrapped around the outside of the sink flange 14, with the magnets 16 facing inwards toward the sink flange 14. Once the first and second ends 48, 50 of the strap member 38, and ultimately the hook material 42 and the loop material 46 overlap, the first and second ends 48, 50 of the strap member 38 are pressed together securing the hook material 42 on the first side 40 of the strap member 38 to the loop material 46 on the second side 44 of the strap member 38, and securing the magnetic strap 12 about the sink flange 14.

The magnetic field of the magnets 16 on the magnetic strap 12 will transfer through the sink flange 14 and into the sink drain hole 54 attracting and trapping any ferrous object located in the sink 18, such as kitchen utensils, flatware, or bottle caps. The magnetic field generated by the magnets 16 will draw the ferrous objects toward the sink flange 14 frictionally holding the ferrous objects thereagainst until removed by a user, therefore preventing the object from inadvertently slipping through the sink drain hole 54 and into the garbage disposal 10 and its blades 57.

It is appreciated the magnets can be of varying sizes and shapes. In addition, it is appreciated the magnets may be arranged upon the strap member in different configurations along the strap. It is further appreciated the strap can also be made of different materials, sizes and shapes, and present alternate fastening methods. The same result could also be obtained with a solid ring-shaped magnet fitted outside the sink flange, or any other magnetic element(s) mounted on the outside and/or under the sink.

While the preferred embodiments have been shown and described, it will be understood that there is no intent to limit the invention by such disclosure, but rather, is intended to cover all modifications and alternate constructions falling within the spirit and scope of the invention.

The invention claimed is:

1. A magnetic strap in combination with a garbage disposal secured to a sink for preventing the undesired passage of articles through a sink drain hole and into the garbage disposal, the combination comprising:

a garbage disposal including a sink flange coupling the garbage disposal with the sink drain hole of the sink;

a magnetic strap secured about the sink flange, the magnetic strap including:

a strap member having a first end and a second end, with mating fastening members provided at the first end and the second end for selectively securing the first end to the second end so as to form a loop; and a plurality of magnets secured to the strap member, the magnets exhibiting sufficient strength to attract and trap ferrous objects by drawing the ferrous objects toward the sink flange where the ferrous objects are frictionally held to thereby prevent the ferrous objects from inadvertently slipping through the sink drain hole and into the garbage disposal.

2. The magnetic strap in combination with the garbage disposal secured to the sink according to claim 1, wherein the mating fastening members are hook-and-loop type fastening material.

3. The magnetic strap in combination with the garbage disposal secured to the sink according to claim 2, wherein hook material is formed on a first side of the strap member and loop material is formed on an opposite second side of the strap member.

4. The magnetic strap in combination with the garbage disposal secured to the sink according to claim 3, wherein each of the plurality of magnets is coupled to the first side of the strap member.

5. The magnetic strap in combination with the garbage disposal secured to the sink according to claim 1, wherein each of the plurality of magnets is made of a ferromagnetic material, such as Neodymium Iron Boron (NIB), Samarium Cobalt (SmCo), or Alnico.

6. The magnetic strap in combination with the garbage disposal secured to a sink according to claim 1, wherein each of the plurality of magnets has a strength of at least 2,000 Gauss.

7. A method for preventing the undesired passage of articles through a sink drain hole and into a garbage disposal, comprising:

applying a plurality of magnets about a sink flange connecting a sink to a garbage disposal such that a magnetic field of the plurality of magnets transfers through the sink flange and onto the sink drain hole attracting and trapping any ferrous object located in the sink by drawing the ferrous object toward the sink flange where the ferrous object is frictionally held.

8. The method according to claim 7, wherein the plurality of magnets is secured to a strap member and the step of applying includes wrapping and securing the strap member about the sink flange.

9. The method according to claim 8, wherein the step of applying includes fastening ends of the strap member together to secure the strap member and the plurality of magnets about the sink flange.

10. The method according to claim 9, wherein the strap member includes hook-and-loop type fastening members.

11. The method according to claim 7, wherein each of the plurality of magnets is made of a ferromagnetic material, such as Neodymium Iron Boron (NIB), Samarium Cobalt (SmCo), or Alnico.

12. The method according to claim 7, wherein each of the plurality of magnets has a strength of at least 2,000 Gauss.

* * * * *